United States Patent [19]

Iino et al.

[11] Patent Number: 4,797,338

[45] Date of Patent: Jan. 10, 1989

[54] PHOTOSENSITIVE MEMBER COMPRISING CHARGE GENERATING LAYER AND CHARGE TRANSPORTING LAYER

[75] Inventors: Syuji Iino, Hirakata; Hideo Hotomi, Suita; Noboru Saeki; Masanori Fujiwara, both of Osaka; Fumiko Uchino, Takatsuki; Izumi Osawa, Ikeda, all of Japan

[73] Assignee: Minolta Camera Kabushiki Kaisha, Osaka, Japan

[21] Appl. No.: 95,930

[22] Filed: Sep. 14, 1987

[30] Foreign Application Priority Data

Sep. 16, 1986 [JP] Japan ..... 61-219005

[51] Int. Cl.[4] ..... G03G 5/10

[52] U.S. Cl. ..... 430/58; 430/78

[58] Field of Search ..... 430/58, 65, 66, 67, 430/84, 95, 78

[56] References Cited

U.S. PATENT DOCUMENTS

| | | | |
|---|---|---|---|
| 3,895,944 | 7/1975 | Wiedemann et al. | 430/58 |
| 3,956,525 | 5/1976 | Yasuba | 430/58 |
| 3,992,205 | 11/1976 | Wiedemann | 430/58 |
| 4,366,208 | 12/1982 | Akai et al. | 430/84 |
| 4,394,425 | 7/1983 | Shimiza et al. | 430/95 |
| 4,426,434 | 1/1984 | Arishima et al. | 430/58 |
| 4,490,450 | 12/1984 | Shimizu et al. | 430/84 |
| 4,634,648 | 1/1987 | Jansen et al. | 430/84 |
| 4,675,265 | 6/1987 | Kazami et al. | 430/58 |

FOREIGN PATENT DOCUMENTS

| | | |
|---|---|---|
| 49-11136 | 6/1974 | Japan . |
| 50-30526 | 3/1975 | Japan . |
| 51-46130 | 4/1976 | Japan . |
| 55-29844 | 2/1980 | Japan . |
| 55-86169 | 6/1980 | Japan . |
| 57-64239 | 4/1982 | Japan . |
| 57-148745 | 4/1983 | Japan . |
| 57-20741 | 5/1983 | Japan . |
| 58-139154 | 8/1983 | Japan . |
| 59-136742 | 8/1984 | Japan . |
| 59-214859 | 12/1984 | Japan . |
| 61-761 | 4/1985 | Japan . |
| 60-101541 | 6/1985 | Japan . |
| 60-249155 | 12/1985 | Japan . |
| 61-94056 | 5/1986 | Japan . |
| 61-289355 | 12/1986 | Japan . |

OTHER PUBLICATIONS

Journal of Applied Polymer Science, vol. 17, 1973.

"A C-nmr Investigation of Plasma Polymerized Ethane, Ethylene, and Acetylene" Dilks et al., Journal of Polymer Science, vol. 19, 1981.

*Primary Examiner*—John L. Goodrow

*Attorney, Agent, or Firm*—Burns, Doane, Swecker & Mathis

[57] ABSTRACT

A photosensitive member of the present invention comprises an electrically conductive substrate, an evaporated layer of phthalocyanine compounds as a charge generating layer and a hydrogen-containing amorphous carbon layer as a charge transporting layer.

The charge transporting layer contains hydrogen in an amount of about 30 to about 60 atomic % based on the combined amount of hydrogen atoms and carbon atoms.

4 Claims, 3 Drawing Sheets

PHOTOSENSITIVE MEMBER COMPRISING CHARGE GENERATING LAYER AND CHARGE TRANSPORTING LAYER

BACKGROUND OF THE INVENTION

1. Field of the Invention:

The present invention relates to a photosensitive member of the function-separated type comprising an evaporated film of phthalocyanine compounds as a charge generating layer and a hydrogen-containing amorphous carbon layer as a charge transporting layer.

2. Description of the Prior Art:

Remarkable progress has been made in the application of electrophotographic techniques since the invention of the Carlson process. Various materials have also been developed for use in electrophotographic photosensitive members.

Conventional photoconductive materials chiefly include inorganic compounds such as amorphous selenium, selenium-arsenic, selenium-tellurium, zinc oxide, amorphous silicon and the like, and organic compounds such as polyvinylcarbaxole, metal phthalocyanine, disazo pigments, tris-azo pigments, perillene pigments, triphenylmethanes, triphenylamines, hydrazones, styryl compounds, pyrazolines, oxazoles oxadiazoles and the like. The structures of photosensitive members include, for example, those of the single-layer type wherein such a material is used singly, the binder type wherein the material is dispersed in a binder, and the function-separated type comprising a charge generating layer and a charge transporting layer.

However, conventional photoconductive materials have various drawbacks. For example, the above-mentioned inorganic materials except for amorphous silicon (a-Si) are harmful to the human body.

The electrophotographic photosensitive member, when employed in a copying apparatus, must always have stabilized characteristics even if it is subjected to the severe environmental conditions of charging, exposure, developing, image transfer, removal of residual charges and cleaning. However the foregoing organic compounds have poor durability and many unstable properties.

In order to eliminate these drawbacks, progess has been made in recent years in the application of a-Si formed by the glow discharge process to electrophotographic photosensitive members as a material with reduced harmfulness, higher sensitivity, higher hardness such as more than 7H level of the JIS standards for pencil lead hardness and higher durability. Nevertheless, a-Si material is hazardous to manufacture since it requires highly ignitable silane gas as its starting material. Moreover, a-Si requires a large quantity of silane gas which is expensive, rendering the resulting photosensitive member much more closely than conventional photosensitive members. The manufacture of photosensitive members of a-Si involves many other disadvantages, for example, a-Si has a low film-forming speed and releases a large amount of explosive undecomposed silane products in the form of particles when forming a film. Such particles, when incorporated into the photosensitive member being produced, gives seriously adverse influences on the quality of images obtained. Further, a-Si has a low chargeability due to its original high relative dielectric constant. This necessitates the use of a charger of higher output to charge the a-Si photosensitive member to a predetermined surface potential in the copying apparatus.

It is conventionally known that the evaporated film formed from phthalocyanine compounds can be employed as a charge generating layer in a photosensitive member. In the Journal of Non-Crystalline Solid, Vol. 6, pp. 13–26, 1971, for example, P. J. Regensburger and N. L. Petruzzella state that a photosensitive member comprising a charge generating layer of an evaporated film of metal-free phthalocyanine and a charge transporting layer of amorphous selenium exhibits desirable light decay.

Many inventions are directed to an evaporated film of phthalocyanine applicable as a charge generating layer. At the same time, many inventions concern charge transporting materials which are excellent in adhesivity, charge transportability and charge injection from a charge generating layer which functions as an excellent photosensitive member by lamination to the above-mentioned charge generating layer.

For example, U.S. Pat. No. 3,895,944 discloses a photosensitive member which comprises an evaporated film of phthalocyanine either metal-free or containing metal such as Cu, Cd, Zn, Pb and the like, as a charge generating layer, and a charge transporting layer of oxidiazole coated on the evaporated film.

Japanese Unexamined Patent Publication No. SHO 49-11136 discloses a photosensitive member which comprises an evaporated film of phthalocyanine either metal-free or containing metal such as Cu, Ni, Co and the like, formed on a resin layer of low resistance and serving as a charge generating layer, and an organic photoconductive material such as poly-N-vinylcarbazole, polyacenaphthylene, poly-9-vinylacridine and the like, is coated thereon as a charge transporting layer.

U.S. Pat. No. 3,992,205 disclosed a photosensitive member which comprises a charge generating layer having an evaporated layer of metal-free or Cu phthalocyanine and another evaporated layer of other coloring agent in a laminated structure, and an organic material such as N-vinylcarbazole, pyrazoline and the like is coated on the charge generating layer as a charge transporting layer.

Japanese Unexamined Patent Publication No. SHO 57-20741 discloses a photosensitive member comprised of evaporated film of Cu phthalocyanine, as a charge generating layer, and an organic compound, such as pyrazoline, N-carbazole and the like, is coated thereon as a charge transporting layer.

Japanese Unexamined Patent Publication No. SHO 57-148745 discloses a photosensitive member which comprises an evaporated film of phthalocyanine containing metal, such as Al, Cr, Ga, Sb, In, Si, Ti, Ge, Sn, Te and the like, as a charge generating layer, and an organic compound, such as pyrazoline, carbazole and the like, coated thereon as a charge transporting layer.

U.S. Pat. NO. 4,426,434 discloses a photosensitive member which comprises an evaporated film of phthalocyanine as a charge generating layer containing Al as a metal and Cl as a substitute (AlPc, AlClPc, AlClPc(Cl)), and an organic compound of pyrazoline is coated thereon as a charge transporting layer, the evaporated film being treated by a solvent such as THF, acetone and the like.

These disclosed inventions are all directed to a photosensitive member wherein a charge transporting layer comprising organic charge transporting material is coated on an evaporated film of phthalocyanine compounds. Photosensitive members of this structure have low hardness, since the surface of the members is formed of an organic coated film, showing hardness of only 5B to 2B level of the JIS standards for pencil lead hardness. Therefore, such photosensitive members, when used in a copying apparatus, have low wear and abrasion resistance against contact with the developing device, transfering device, cleaning device and the like, showing poor durability. Moreover, the evaporated film of phthalocyanine may be altered by the solvent used for coating, thereby affecting the photosensitive characteristics, especially the spectral sensitivity characteristics. This may limit the effective use of the evaporated film of phthalocyanine. Additionally, the photosensitive members are prepared by applying the evaporated film in a vacuum, and then, coating the organic charge transporting layer thereon outside the vacuum chamber. From the manufacturing viewpoint the above-mentioned process is a complicated one.

Japanese Unexamined Patent Publication No. SHO 55-29844 discloses a photosensitive member comprising an evaporated film of phthalyocyanine, containing metal such as Cu, Ni, Fe, Mg, Al and the like, as a charge generating layer, and a film formed from an organic compound of pyrazoline coated thereon as a charge transporting layer. The charge transporting layer is coated by evaporation, sputtering and ion plating method.

By this process, the photosensitive members having relatively high hardness up to the H to 2H level according to JIS standards for pencil lead hardness, can be obtained. However, compared to the amorphous silicon described above, such members are not hard enough. Further, the coating method reduces the charge transportability of pyrazoline compounds having inherently suitable hole transportability. Consequently, suitable sensitivity cannot always be obtained.

Moreover, the above disclosure about function-separate photosensitive members using an evaporated film of phthalocyanine as a charge generating layer do not solve the substantial problems described above inherent to a-Si.

On the other hand, it has been proposed in recent years to use amorphous carbon films as plasma-polymerized organic films for photosensitive members.

Plasma-polymerized organic films per se have been well-known for a long time. In Journal of Applied Polymer Science, Vol. 17, pp. 885–892, 1973, for example, M. Shen and A. T. Bell state that a plasma-polymerized organic film can be produced from the gas of any organic compound. The same authors discuss film formation by plasma polymerization in "Plasma Polymerization," published by the American Chemical Society in 1979.

However, the plasma-polymerized organic films prepared by the conventional process have been used only as insulating films. They are thought to be insulating films having a specific resistivity of about $10^{16}$ ohm-cm, like usual polyethylene films, or as used are recognized at least as such. The use of this film with electrophotographic photosensitive members is based also on the same concept; the film has found only limited use as an undercoat or overcoat serving solely as a protective layer, adhesion layer, blocking layer or insulating layer.

For example, Unexamined Japanese Patent Publication SHO 59-28161 discloses a photosensitive member which comprises a plasma-polymerized high polymer layer of reticular structure formed on a substrate and serving as a blocking-adhesion layer, and an a-Si layer formed on the polymer layer. Unexamined Japanese Patent Publication SHO 59-38753 discloses a photosensitive member which comprises a plasma-polymerized film having a thickness of 10 to 100 angstroms and formed over a substrate as a blocking-adhesion layer, and an a-Si layer formed on the film, the plasma-polymerized film being prepared from a gas mixture of oxygen, nitrogen and a hydrocarbon and having a high resistivity of $10^{13}$ to $10^{15}$ oh-cm. Unexamined Japanese Patent Publication SHO 59-136742 discloses a photosensitive member wherein an aluminum substrate is directly coated with a carbon film having a thickness of about 1 to about 5 μm and serving as a protective layer for preventing aluminum atoms from diffusing through an a-Si layer formed over the substrate when the member is exposed to light. Unexamined Japanese Patent Publication SHO 60-63541 discloses a photosensitive member wherein a diamond-like carbon film, 200 angstroms to 2 μm thick, is interposed between an aluminum substrate and an overlaying a-Si layer to serve as an adhesion layer to improve the adhesion between the substrate and the a-Si layer. The publication says that the film thickness is preferably up to 2 μm in view of the residual charge.

The above disclosed inventions are all directed to a so-called undercoat provided between the substrate and the a-Si layer. In fact, these publications mention nothing whatever about charge transporting properties, nor do they offer any solution to the foregoing substantial problems with a-Si.

Furthermore, U.S. Pat. No. 3,956,525, for example, discloses a photosensitive member of the polyvinylcarbazoleselenium type coated with a polymer film having a thickness of 0.1 to 1 μm and formed by glow discharge polymerization as a protective layer. Unexamined Japanese Patent Publication SHO 59-214859 discloses a technique for protecting the surface of an a-Si photosensitive member with an approximately 5-μm-thick film formed by plasma-polymerizing an organic hydrocarbon monomer such as styrene or acetylene. Unexamined Japanese Patent Publication SHO 60-61761 discloses a photosensitive member having a diamond-like carbon thin film, 500 angstroms to 2 μm thick and serving as a surface protective layer. Preferably the film thickness is up to 2 μm due to trasmittancy. Unexamined Japanese Patent Publication SHO 60-249115 discloses a technique for forming a film of amorphous carbon or hard carbon with a thickness of about 0.05 to about 5 μm for use as a surface protective layer. The publications states that the film adversely affects the activity of the protected photosensitive member when exceeding 5 μm thick.

The above disclosed inventions are all directed to a so-called overcoat formed over the surface of the photosensitive member. The publications disclose nothing whatever about charge transporting properties, nor do they solve the aforementioned substantial problems of a-Si in any way.

Unexamined Japanese Patent Publication SHO 51-46130 discloses an electrophotographic photosensitive member of the polyvinylcarbazole type which has a polymer film 0.001 to 3 μm thick and formed on its surface by being subjected to glow discharge polymerization. Nevertheless, the publication is totally mute about charge transporting properties, further failing to solve the foregoing substantial problems of a-Si.

Thus, the photosensitive members employing the conventional evaporated films of phthalocynine as a charge generating layer exhibit low surface hardness, poor durability and poor sensitivity due to the limited combination with a charge transporting layer.

On the other hand, the conventional plasma-polymerized organic films for use in electrophotographic photosensitive members are used as undercoats or overcoats because of their insulating properties and need not have a carrier transporting function. Accordingly, the films used are of limited in thickness, up to about 5 μm at the largest. Carriers pass through the film owning to a tunnel effect, while if the tunnel effect is not expected, the film used has such a small thickness that it will not pose actual residual potential problems.

SUMMARY OF THE INVENTION

The main object of the present invention is to provide a photosensitive member having excellent electrophotographic characteristics and high sensitivity.

Another object of the invention is to provide a photosensitive member which has excellent charge transportability, charging characteristics and durability.

Still another object of the invention is to provide a photosensitive member which is highly resistant to moisture and weather and has excellent transmittancy.

These and other objects of the invention can be accomplished by providing a photosensitive member comprising an electrically conductive substrate, a vacuum evaporated layer formed from phthalocyanine compounds and serving as a charge generating layer and a plasma polymerized layer serving as a charge transporting layer and comprising amorphous carbon containing hydrogen.

DEATILED DESCRIPTION OF THE INVENTION

Figure 1:
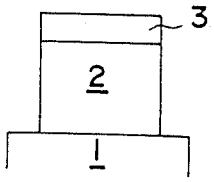
FIGS. 1 to 6 are diagrams showing photosensitive members embodying the invention.

The photosensitive member embodying the present invention is characterized in that the member comprises a vacuum evaporated film of phthalocyanine compound as a charge generating layer (hereinafter referred to as a ve-Pc layer) and a plasma-polymerized film prepared by applying a glow discharge to the gases of organic compounds in a vacuum as a charge transporting layer (hereinafter referred to as a "a-C layer").

We have conducted research on the application of evaporated films of phthalocyanine and plasma-polymerized organic layers to photosensitive members of the function-separated type and found that the polymerized layer, which is originally thought to be an insulating layer, readily exhibits the ability to transport charges and functions as a suitable charge transporting layer when laminated with the evaporated films of phthalocyanine.

The charge generating layer exhibit distinct photoconductive properties when exposed to light in the wavelength vicinity of semiconductor laser beams, effectively generating light excited carriers. The charge transporting layer does not exhibit distinct photoconductive properties when exposed to visible light or light in the wavelength vicinity of semiconductor laser beams, but has suitable ability to transport charges and has excellent characteristics for use in electrophotographic photosensitive members, e.g. chargeability, transmittancy, and durability and resistance to moisture, weather and environmental pollution. The layer therefore affords a high degree of freedom in providing laminate structures for use as photosensitive members of the function-separated type. Further, the member has excellent adhesivity of the charge generating layer and charge transporting layer, and has excellent injection of light excited carriers.

The photosensitive member of the present invention comprises at least a charge generating layer and a charge transporting layer.

The charge generating layer of the present invention, i.e., ve-Pc layer can be prepared from a method of general vacuum evaporation. The charge generating layer is produced by using phthalocyanine compounds as the source. Examples of suitable phthalocyanine compounds are CuPc, AlClPc(Al), AlClPc, $H_2Pc$, Ge-$(OH)_2Pc$, ZnPc, MgPc, $K_2Pc$ and the like.

It is suitable that the ve-Pc layer serving as a charge generating layer of the invention be 200 angstroms to 2 microns thick. Thicknesses smaller than 200 angstroms reduce the light absorbing amount, resulting in a decrease the number of light excited carriers causing a reduction in sensitivity. On the other hand, thickness larger than 2 microns impairs chargeability because the effect of the heat excited carriers in the charge generating layer cannot be ignored. Further, the charge transporting efficiency in the charge generating layer is liable to be reduced, so that the suitable sensitivity is not always assured.

The ve-Pc layer of the invention can be applied by post-treatment of an organic solvent after evaporation in order to adjust spectral sensitivity characteristics. More specifically, the member is dipped in an organic solvent or exposed in an atmosphere of organic solvent after forming the evaporated layer. The time required for dipping or exposing may be adjusted according to the evaporation materials. Examples of useful organic solvents are acetone, THF and the like.

The charge transporting layer of the present invention, i.e., the a-C layer, can be prepared by a general plasma chemical vapor deposition (P-CVD) method. According to the present invention, organic gases, especially hydrocarbons are used as organic gases for forming the a-C layer. The hydrocarbons need not always be in a gaseous phase at room temperature and atmospheric pressure but rather can be in a liquid or solid phase insofar as they can be vaporized upon melting, evaporation or sublimation, for example, by heating or use of vacuum. Examples of useful hydrocarbons are saturated hydrocarbons, unsaturated hydrocarbons, alicyclic hydrocarbons, aromatic hydrocarbons and the like. Such hydrocarbons are usable in combination.

A wide variety of hydrocarbons are usable. Examples of useful saturated hydrocarbons are normal paraffins such as methane, ethane, propane, butane, pentane, hexane, heptane, octane, nonane, decane, undecane, dodecane, tridecane, tetradecane, pentadecane, hexadecane, deptadecane, octadecane, nonadecane, eicosane, heneicosane, docosane, tricosane, tetracosane, pentacosane, hexacosane, heptacosane, octacosane, nonacosane, triacontane, dotriacontane, pentatriacontane, etc.; isoparaffins such as isobutane, isopentane, neopentane, isohexane, neohexane, 2,3-dimethylbutane, 2-methylhexane, 3-ethylpentane, 2,2-dimethylpentane, 2,4-dimethylpentane, 3,3-dimethylpentane, tributane, 2-methylheptane, 3-methylheptane, 2,2-dimethylhexane, 2,2,5-dimethylhexane, 2,2,3-trimethylpentane, 2,2,4-trimethylpentane, 2,3,3-trimethylpentane, 2,3,4-trimethylpentane, isononane, etc,; and the like.

Examples of useful unsaturated hydrocarbons are olefins such as ethylene, propylene, isobutylene, 1-butene, 2-butene, 1-pentene, 2-pentene, 2-methyl-1-butene, 3-methyl-1-butene, 2-methyl-2-butene, 1-hexene, tetramethylethylene, 1-heptene, 1-octene, 1-nonene, 1-decene and the like; diolefins such as allene, methyl-allene, butadiene, pentadiene, hexadiene, cyclopentadiene and the like; triolefins such as ocimene, alloocimene, myrcene, hexatriene and the like; acetylene, methylacetylene, 1-butyne, 2-butyne, 1-pentyne, 1-hexyne, 1-heptyne, 1-octyne, 1-nonyne, 1-decyne and the like.

Examples of useful alicyclic hydrocarbons are cycloparaffins such as cyclopropane, cyclobutane, cyclopentane, cyclohexane, cycloheptane, cyclooctane, cyclononane, cyclodecane, cycloundecane, cyclododecane, cyclotridecane, cyclotetradecane, cyclopentadecane, cyclohexadecane and the like; cycloolefins such as cyclopropene, cyclobutene, cyclopentene, cyclohexene, cycloheptene, cyclooctene, cyclononene, cyclodecene and the like; terpenes such as limonene, terpinolene, phellandrene, sylvestrene, thujene, carene, pinene, bornylene, camphene, fenchene, cyclofenchene, tricyclene, bisabolene, zingiberene, curcumene, humulene, cadinenesesquibenihene, selinene, caryophyllene, santalene, cedrene, camphorene, phyllocladene, podocarprene, mirene and the like; steroids; etc.

Examples of useful aromatic hydrocarbons are benzene, toluene, xylene, hemimellitene, pseudocumene, mesitylene, prehnitene, isodurene, durene, pentamethylbenzene, hexamethylbenzene, ethylbenzene, propylbenzene, cumene, styrene, biphentyl, terphenyl, diphenylmethane, triphenylmethane, dibenzyl, stilbene, indene, napthalene, tetralin, anthracene, phenanthrene and the like.

Examples of suitable carrier gases are $H_2$, Ar, Ne, He and the like, which are generally used in a P-CVD method.

The a-C layer prepared by only using the hydrocarbons and carrier gases comprises only carbon atoms and hydrogen atoms. It is suitable that the a-C layer contains about 30 to 60 atomic % of hydrogen atoms based on the combined amount of hydrogen atoms and carbon atoms.

The hydrogen content of the a-C layer of the invention is variable in accordance with the film forming apparatus and film forming conditions. The hydrogen content can be decreased, for example, by elevating the substrate temperature, lowering the pressure, reducing the degree of dilution of the starting materials, applying a greater power, decreasing the frequency of the alternating electric field to be set up, increasing the intensity of a d.c. electric field superposed on the alternating electric field or a combination of such procedures.

Suitably the a-C layer serving as the charge transporting layer of the invention is 5 to 50 microns, preferable 7 to 20 microns, thick for use in the usual electrophotographic process. Thickness smaller than 5 microns result in a lower charge potential, failing to give a sufficient copy image density. Thickness larger than 50 microns are not desirable from a productivity view point. The a-C layer has high transmittancy, dark resistivity and charge transportability, traps no carriers even when not smaller than 5 microns thick as mentioned above and contributes to light decay.

The photosensitive member of the present invention exhibits high sensitivity and high durability, with a surface hardness of more than 7H level on the JIS standard for pencil lead hardness. Further, the member of the invention can be manufactured more safely than the a-Si photosensitive member.

According to the invention, foreign elements can be incorporated into the a-C layer as a chemical modifier in order to adjust the photosensitive characteristics. For example, halogen atoms, silicon atoms, germanium atoms, atoms of elements in Group IIIA or Group VA of the Periodic Table, and the like, may further be incorporated into the a-C layer so as to adjust the dark decay characteristics. Further, in order to improve chargeability and changes of thickness properties after a lapse of time, halogen atoms, oxygen atoms, nitrogen atoms and the like many be incorporated into the a-C layer. More specifically, the a-C layer of the present invention containing the foreign elements can be prepared from the P-CVD method by using starting materials wherein inorganic compound gases or organic compound gases containing the foreign elements in its molecular structure are mixed with hydrocarbon gases, or by using the organic compound gases containing the foreign elements in its molecular structure as a starting material. Further, the quantity of the foreign elements to be contained in the a-C layer is controllable by varying the amount of inorganic or organic compound gases containing the foreign elements in its molecular structure in the case of using the mixture of hydrocarbon gases and said inorganic or organic compound gases. When the organic compound gases containing the foreign elements in its molecular structure as a starting material are used, the quantity of the foreign elements is controllable by using suitably selected organic compounds having a high or low content ratio of the foreign elements in its molecular structure.

The inorganic or organic compounds need not always be in a gas phase at room temperature and atmospheric pressure but can be a liquid or solid provided that the compound can be vaporized on melting, evaporation or sublimation, for example, when heated or subjected to a vacuum.

The photosensitive member of the present invention comprises a charge generating layer of ve-Pc, and a charge transporting layer of a-C, which are fored in a suitable superposed structure as required.

Figure 2:
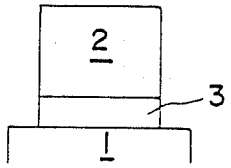
Figure 3:
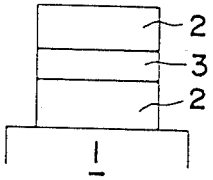

FIG. 1 shows a photosensitive member of one type comprising an electrically conductive substrate 1, a charge transporting layer 2 formed on the substrate and a charge generating layer 3 formed on the layer 2. FIG. 2 shows another type comprising an electrically conductive substrate 1, a charge generating layer 3 on the substrate and a charge transporting layer 2 on the layer 3. FIG. 3 shows another type comprising an electrically conductive substrate 1, and a charge transporting layer 2, a charge generating layer 3 and another charge transporting layer 2 formed over the substrate and arranged one over another.

These photosensitive members are used, for example, by positively charging the surface with a corona charger or the like and exposing the charged surface to an optical image. In the case of FIG. 1, the holes then generated in the charge generating layer 3 travel through the charge transporting layer 2 toward the substrate 1. In FIG. 2, the electrons generated in the charge generating layer 3 travel through the charge transporting layer 2 toward the surface of the photosensitive member. In FIG. 3, the holes generated in the charge generating layer 3 travel through the lower charge transporting layer 2 toward the substrate 1, and at the same time, the electrons generated in the charge generating layer 3 travel through the upper transporting layer 2 toward the surface of the member. Consequently, an electrostatic latent image is formed, with satisfactory light decay assured. Conversely, when the surface of the photosensitive member is negatively charged and then exposed, the electron and the hole may be replaced by each other with regard to the above described behavior on the travel of carreirs. With the structures of FIGS. 2 and 3, the image projecting light passes through the charge transporting layer, which nevertheless has a high transmittancy, permitting satisfactory formation of the latent image.

Figure 4:
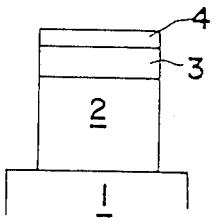

FIG. 4 shows another type comprising an electrically conductive substrate 1, and a charge transporting layer 2, a charge generating layer 3 and a charge transporting layer 4 provided over the substrate and arranged one over another. Thus, the illustrated structure corresponds to the structure of FIG. 1 provided with a surface protective layer. The outermost surface of the structure of FIG. 1 is provided by a charge generating layer of a-Si having poor humidity resistance. Therefore in the present invention, it is generally desirable that the surface be covered with a protective layer to assure humidity stability. With the structures of FIGS. 2 and 3, the charge transporting layer of the invention with its high durability is the outermost surface, so that a surface protective layer need not be provided. However, these a photosensitive member can be formed with a surface protective layer, as another type, so as to be compatible with various other elements within the copying machine. For example, to be free from developer surface soiling deposition.

Figure 5:
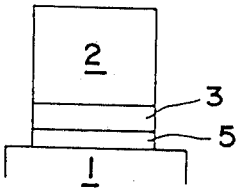

FIG. 5 shows another type comprising an electrically conductive substrate 1, an intermediate layer 5, a charge generating layer 3 and a charge transporting layer 2 which are formed over the substrate and arranged one over another. Thus, this structure corresponds to the structure of FIG. 2 provided with an intermediate layer. Since a charge generating layer of a-Si is joined to the substrate in the structure of FIG. 2, it is generally desirable to interpose an intermediate layer therebetween to assure good adhesion and an injection inhibitory effect. With the structures of FIGS. 1 and 3, the charge transporting layer of the invention, which has excellent adhesion and injection inhibitory effect, is joined to the substrate, so that no intermediate layer need be provided. However, the photosensitive member of either of these types can be formed with an intermediate layer in order to render the transporting layer compatible with the preceding fabrication step, such as pretreatment of the conductive substrate. Another type of photosensitive member is then available.

Figure 6:
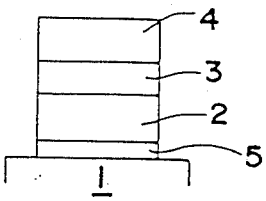

FIG. 6 shows another type comprising an electrically conductive substrate 1, and an intermediate layer 5, a charge transporting layer 2, a charge generating layer 3 and a surface protective layer 4, which are formed over the substrate and superposed one over another. Thus, this structure corresponds to the structure of FIG. 1 provided with an intermediate layer and a surface protective layer. The intermediate and protective layers are formed for the same reasons as already stated. Thus, the provision of these two layers in the structure of FIG. 2 or 3 affords another type.

According to the present invention, the intermediate layer and the surface protective layer are not limited specifically in material or fabrication process. Any material or process is suitably selectable, provided that the contemplated object is achieved. The a-C layer of the invention may be used. However, if the material to be used is an insulating material such as one already mentioned, the thickness of the layer needs to be less than 5 microns to preclude the occurrence of residual potential.

The charge generating layer of the photosensitive member embodying the present invention is produced by a resistance heating method wherein phthalocyanine materials in a solid phase are heated in a vacuum phase, and the vapors of phthalocyanine generated are accumulated into a solid phase on the substrate by condensation.

The charge transporting layer of the photosensitive member embodying the present invention is produced by so-called plasma polymerization wherein molecules in a vapor phase are subjected to discharge decomposition in a vacuum phase. Active neutral seeds or charge seeds contained in the resulting atmosphere of plasma are led onto a substrate by diffusion or an electric or magnetic force and accumulated into a solid phase on the substrate through a rebinding reaction.

Figure 7:
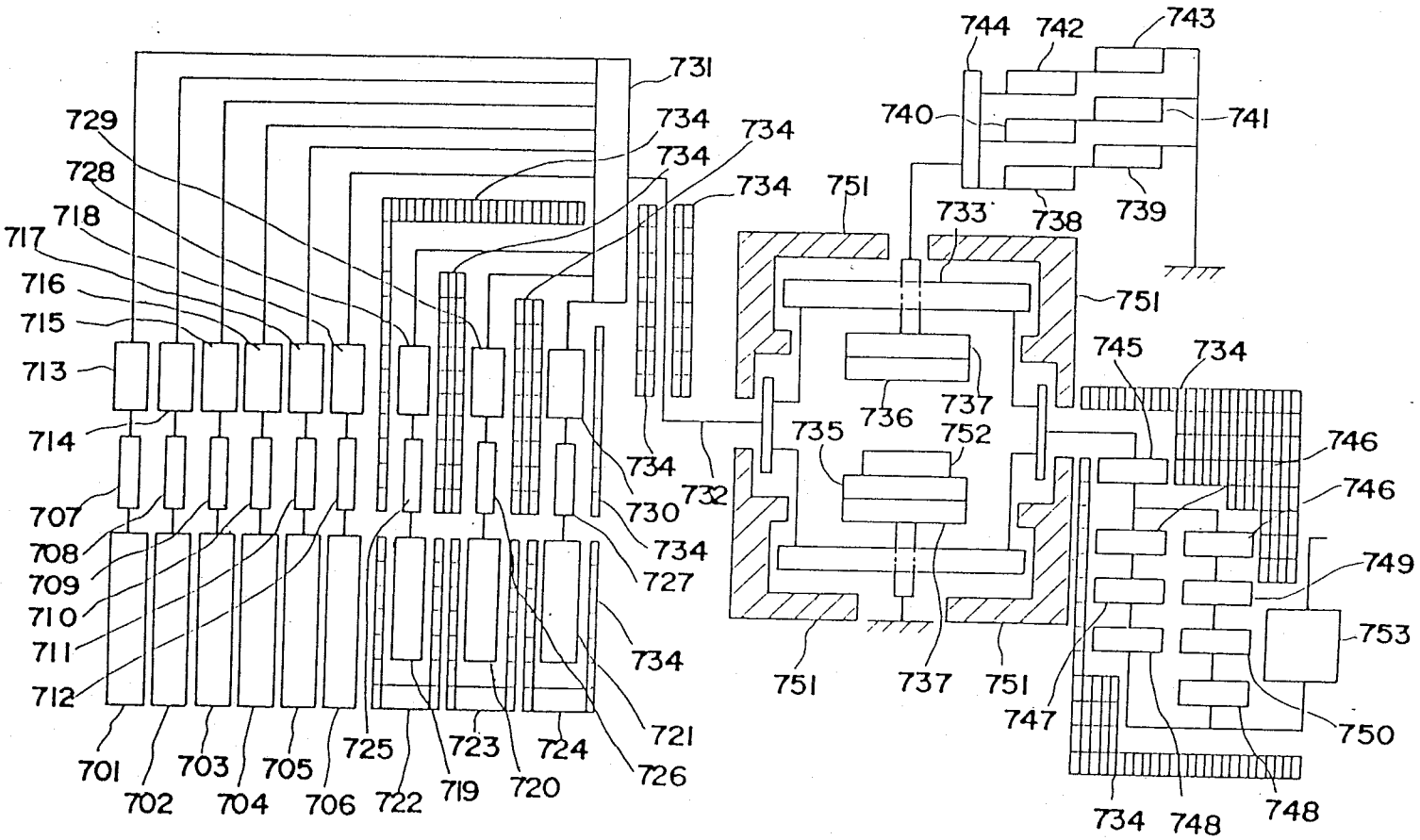
FIGS. 7 and 8 are diagrams showing apparatus for preparing photosensitive members of the invention.

FIG. 7 shows an apparatus for preparing the photosensitive member of the invention. First to sixth tanks 701 to 706 have enclosed therein starting material compounds which are in gas phase at room temperature and a carrier gas and are connected respectively to first to sixth regulator valves 707 to 712 and first to sixth flow controllers 713 to 718. First to third containers 719 to 721 contain starting material compounds which are liquid or solid at room temperature, can be preheated by first to third heaters 722 to 724 for vaporizing the compounds, and are connected to seventh to ninth regulator valves 725 to 727 and seventh to ninth flow controllers 728 to 730, respectively. The gases to be used, as selected from amoung the above gases, are mixed together by a mixer 731 and fed to a reactor 733 via a main pipe 732. The interconnecting piping can be heated by a pipe heater 734, which is suitably disposed so that the material compound, in a liquid or solid phase at room temperature and vaporized by preheating, will not condense during transport. A grounded electrode 735 and a power application electrode 736 are arranged opposed to each other within the reactor 733. Each of these electrodes can be heated by an electrode heater 737. The power application electrode 736 is connected to a high-frequency power source 739 via a high-frequency power matching device 738, to a low-frequency power source 741 via a low-frequency power matching device 740 and to a d.c. power source 743 via a low-pass filter 742. Power of one of the different frequencies is applicable to the electrode 736 by way of a connection selecting switch 744. The internal pressure of the reactor 733 is adjustable by a pressure control valve 745. The reactor 733 is evacuated by a diffusion pump 747 and an oil rotary pump 748 via an exhaust system selecting valve 746, or by a cooling-removing device 749, a mechanical booster pump 750 and an oil rotary pump 748 via another exhaust system selecting value 746. The exhaust gas is further made harmless by a suitable removal device 753 and then released to the atmosphere. The evacuation piping system can also be heated by a suitably disposed pipe heater 734 so that the material compound which is liquid or solid at room temperature and vaporized by preheating will not condense during transport. For the same reason, the reactor 733 can also be heated by a reactor heater 751. An electrically conductive substrate 752 is placed on the electrode 735 in the reactor. Although FIG. 7 shows that the substrate 752 is fixed to the grounded electrode 735, the substrate may be attached to the power application electrode 736, or to both the electrodes.

Figure 8:
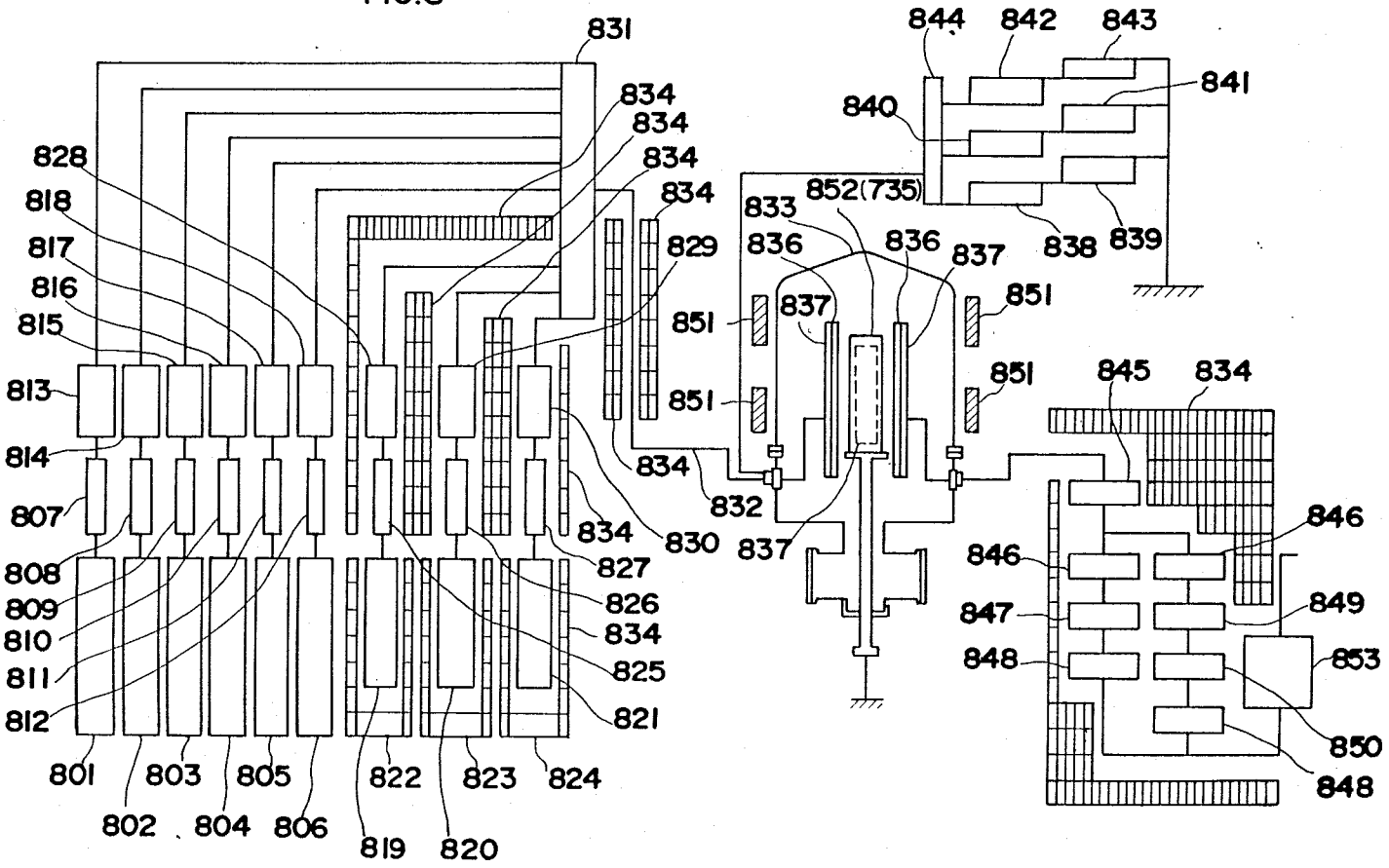

FIG. 8 shows another type of apparatus for preparing the photosensitive member of the invention. This apparatus has the same construction as the apparatus of FIG. 7 with the exception of the interior arrangement of the reactor 833. The numerals shown by 700 order in FIG. 7 are replaced by the numerals at 800 order in FIG. 8. With reference to FIG. 8, the reactor 833 is internally provided with a hollow cylindrical electrically conductive substrate 852 serving also as the grounded electrode 735 of FIG. 7 and with an electrode heater 837 inside thereof. A power application electrode 836, similarly in the form of a hollow cylinder, is provided around the substrate 852 and surrounded by an electrode heater 837. The conductive substrate 852 is rotatable about its own axis by motor from outside.

The apparatuses shown in FIGS. 7 and 8 for preparing the charge transporting layer of the invention may be connected to a vacuum exaporation apparatus for preparing a charge generating layer through, for example, a gate valve. By this structure, the substrate is transported by a transporting system so that both layers, i.e., the charge generating layer and charge transporting layer can be formed without destroying a vacuum. In addition, when the apparatuses shown in FIGS. 7 and 8 are connected to a vacuum evaporation apparatus as described above, the property of each layer is not contaminated because each layer is prevented from exposing in the atmosphere until after complete formation of the photosensitive member. As a result, the member can be manufactured stabilily. Further, high productivity can be obtained since essential operations are reduced.

The reactors shown in FIGS. 7 and 8 for preparing the photosensitive member are first evacuated by the diffusion pump to a vacuum of about $10^{-4}$ to about $10^{-6}$ torr, whereby the adsorbed gas inside the reactor is removed. The reactor is also checked for the degree of vacuum. At the same time, the electrodes and the substrate fixedly placed on the electrode are heated to a predetermined temperature. To obtain a photosensitive member of one of the foregoing desired structures, an undercoat layer or a charge generating layer may be formed on the substrate before the charge transporting layer is formed, when so required. The undercoat or charge generating layer may be formed by the present apparatus, by some other apparatus or by a vacuum evaporation apparatus connected to the present apparatus through a gate valve. Subsequently, material gases are fed into the reactor from the first to sixth tanks and the first to third containers (i.e. from those concerned), each at a specified flow rate, using the flow controllers concerned, i.e. first to ninth flow controllers, and the interior of the reactor is maintained at a predetermined vacuum by the pressure control valve. After the combined flow of gases has become stabilized, the high-frequency power source, for example, is selected by the connection selecting switch to apply a high-frequency power to the power application electrode. This initiates discharge across the two electrodes, forming a solid layer on the substrate with time. The thickness of the layer is controllable by varying the reaction time, such that the discharge is discontinued upon the thickness reaching the desired value. Consequently, the a-C layer of the invention is obtained which serves as a charge transporting layer.

The a-C layer is a plasma polymerized layer comprising at least carbon atoms and hydrogen atoms as constituent atoms.

Next the regulator valves concerned are closed, and the reactor is thoroughly exhausted. When a photosensitive member of the desired structure has been formed according to the invention, the vacuum within the reactor is vitiated and the member is removed from the reactor. If a charge generating layer or overcoat layer needs to be further formed to obtain the desired photosensitive structure, the layer is formed using the present apparatus as it is, using another apparatus or using a vacuum evaporation apparatus connected to the present apparatus through a gate valve, whereby the desired photosensitive member is obtained according to the invention.

The present invention will be described with reference to the following examples.

EXAMPLE 1

Using an apparatus for practicing the present invention, a photosensitive member was prepared, the member comprising an electrically conductive substrate (1), a charge generating layer (3) and a charge transporting layer (2) provided in this order as shown in FIG. 2.

Charge Generating Layer Forming Step (CGL):

An evaporated film of copper phthalocyanine (CuPc) was formed on an aluminum substrate measuring 50 mm in length, 50 mm in width and 3 mm in thickness with a vacuum evaporation method. The film was evaporated under a vacuum of $1\times10^{-5}$ to $5\times10^{-5}$ Torr at a boat temperature of 500° to 600° C. for five minutes. The thickness of the thus obtained CuPc layer was about 2000 angstrom.

Charge Transporting Layer Forming Step (CTL):

The glow discharge decomposition apparatus shown in FIG. 7 was used. First, the interior of the reactor 733 was evacuated to a high vacuum of about $10^{-6}$ torr, and the first and second valves 707 and 708 were thereafter opened to introduce hydrogen gas from the first tank 701 into the first flow controller 713 and butadiene gas from the second tank 702 into the second flow controller 714, each at an output pressure of 1.5 kg/cm$^2$. The dials on the flow controllers were adjusted to supply the hydrogen gas at a flow rate of 40 sccm and the butadiene gas at 30 sccm to the reactor 733 through the main pipe 732 via the intermediate mixer 731. After the flows of the gases were stabilized, the internal pressure of the reactor 733 was adjusted to 1.0 torr by the pressure control valve 745. On the other hand, the substrate 752 on which the CuPc evaporated layer was formed at the CGL step was preheated to 75° C. With the gas flow rates and the pressure in stabilized state, 150-watt power with a frequency of 100 KHz was applied to the power application electrode 736 from the low-frequency power source 741 preconnected thereto by the selecting switch 744 to conduct plasma polymerization for 2.5 hours, forming an a-C layer, 7.8 microns in thickness, as a charge transporting layer on the substrate, whereupon the power supply was discontinued, the regulator valves were closed, and the reactor 733 was fully exhausted.

When subjected to organic elementary analysis, the a-C layer thus obtained was found to contain 47 atomic % of hydrogen atoms based on the combined amount of carbon atoms and hydrogen atoms.

Characteristics:

When the photosensitive member obtained was used in the usual Carlson process, the member can be charged to at least −420 V. Specifically, the chargeability per 1 micron (hereinafter referred to as C.A.) was −53 V/microns by calculating from the entire thickness of the member, i.e. 8 microns, indicating that the member had satisfactory charging properties.

The member exhibited a potential reduction from −420 V to −385 V in the dark within five seconds after initial charging. The potential reduction rate (hereinafter referred to as $DDR_5$) was only 8% calculated from the above results, showing that the member had satisfactory charge retentivity.

When the member was initially charged and thereafter exposed to white light to decay the charge to its half potential, the amount of light required for the light decay (hereinafter referred to as E1/2) was about 24 lux-sec. This revealed that the member was satisfactory in light decay characteristics.

Further, when the member was exposed with white light of 80 lux-sec. after the initial charging, the surface potential was measured to −60 V as a residual potential (hereinafter referred to as Vr), showing that the member was usable.

These results indicate that the photosensitive member prepared in the present example according to the invention has suitable chargeability and high photosensitivity, functioning a practical photosensitive member. When the member was used in the Carlson process for forming images thereon, followed by image transfer, sharp copy images were obtained.

The surface hardness of the photosensitive member prepared in the present example according to the invention was measured based on JIS-K-5400 standard. The member showed the surface hardness greater than the 7H level. This revealed that the member has a suitable surface hardness.

EXAMPLES 2 TO 22

Photosensitive members were prepared as with Example 1, each member comprising an electrically conductive substrate (1), a charge generating layer (3) and a charge transporting layer (2) provided in this order as shown in FIG. 2. The charge transporting layers of Examples 2 to 22 were prepared by using the apparatus shown in FIG. 7.

Table 1 shows the various conditions used for forming a charge generating layer, Table 2 shows the various conditions used for forming a charge transporting layer and Table 3 shows the results of the evaluation of each member.

Table 1 and Table 2 show conditions different from Example 1 used for forming a charge generating layer and a charge transporting layer and are classified into 19 items (1) to (19). These items are described at the top column of each Table. Some condition settings shown are common to each example, while others are varying with each example.

Table 1 shows the items (1) to (7) as follows:

(1) materials for evaporation
(2) dimensions of the substrate (length×width×thickness) (unit: mm)
(3) boat temperature (°C.)
(4) vacuum (Torr)
(5) time required for evaporation (minutes)
(6) thickness of the layer (angstrom)
(7) after-treatment process by tetrahydrofuran (THF)

Table 2 shows the items (8) to (19) as follows:

(8) flow rate of hydrogen gas (sccm)
(9) flow rate of material gas (sccm)
(10) flow rate of dopant gas (sccm)
(11) power (watt)
(12) pressure in the reaction chamber (Torr)
(13) substrate temperature (°C.)
(14) kind of the power source
(15) frequency (Hz)
(16) time for plasm polymerization (hour)
(17) thickness of the layer (micron)
(18) hydrogen content (atomic %)
(19) content of the dopant (atomic %)

The result of the evaluation shown in Table 3 is classified into 9 items (20) to (28) as follows:

(20) initial charging potential (V)
(21) thickness of the entire member (micron)
(22) chargeability per 1 micron (V/micron)
(23) $DDR_5$ (%)
(24) E(1/2) (lux-sec.)
(25) residual potential Vr (V)
(26) light quantity required for light decay to a half potential after the initial charging by using a semiconductor laser having a wavelength of 780 nm ($erg/cm^2$)
(27) clearness of the image
(28) hardness (H).

The level of image clearness is represented by o (clear) and x (unclear).

From the results shown in Table 3, it is understood that the photosensitive member according to the present invention has improved chargeability and high sensitivity. Further, the photosensitive member of the present invention can be manufactured by using different kind of phthalocyanine compounds.

In addition, Examples 14 to 17 and 20 teach that the photosensitive member of high sensitivity can be obtained by incorporating halogen atoms in the a-C layer.

TABLE 1

| | Charge Generating Layer Forming Step | | | | | | |
|---|---|---|---|---|---|---|---|
| Ex. No. | (1) | (2) (mm) | (3) (°C.) | (4) (Torr) | (5) (minute) | (6) (Å) | (7) |
| 2 | $H_2Pc$ | 50 × 50 × 3 | 480~500 | $1 \times 10^{-5}$~ $1.8 \times {}^{-5}$ | 5 | 2000 | — |
| 3 | AlClPc | 50 × 50 × 3 | 450~480 | $1 \times 10^{-5}$~ $3 \times 10^{-4}$ | 5 | 2000 | — |
| 4 | TiClPc | 50 × 50 × 3 | 580~620 | $3.5 \times 10^{-5}$~ $4.2 \times 10^{-5}$ | 7 | 1500 | — |
| 5 | $Ge(OH)_2Pc$ | 50 × 50 × 3 | 535~570 | $1.8 \times 10^{-5}$ | 8 | 1500 | — |
| 6 | ZnPc | 50 × 50 × 3 | 570~600 | $2 \times 10^{-5}$~ $3 \times 10^{-5}$ | 6 | 1500 | — |

TABLE 1-continued

| Ex. No. | (1) | (2) (mm) | (3) (°C.) | (4) (Torr) | (5) (minute) | (6) (Å) | (7) |
|---|---|---|---|---|---|---|---|
| | | Charge Generating Layer Forming Step | | | | | |
| 7 | MgPc | 50 × 50 × 3 | 565~590 | $1.5 \times 10^{-5}$~ $1.8 \times 10^{-5}$ | 7 | 1500 | — |
| 8 | $K_2Pc$ | 50 × 50 × 3 | 465~475 | $3 \times 10^{-6}$~ $1.5 \times 10^{-5}$ | 7 | 1500 | — |
| 9 | $(NH_4)_2Pc$ | 50 × 50 × 3 | 470~510 | $1.5 \times 10^{-5}$~ $2 \times 10^{-5}$ | 6 | 1500 | — |
| 10 | $Na_2Pc$ | 50 × 50 × 3 | 520~570 | $5 \times 10^{-5}$~ $3 \times 10^{-4}$ | 7 | 1500 | — |
| 11 | AlClPc(Cl) | 50 × 50 × 3 | 450~490 | $5 \times 10^{-6}$~ $1 \times 10^{-4}$ | 5 | 500 | — |
| 12 | $Li_2Pc$ | 50 × 50 × 3 | 700~800 | $5 \times 10^{-4}$ | 3 | 500 | — |
| 13 | AlClPc(Cl) | 50 × 50 × 3 | 450~490 | $5 \times 10^{-6}$~ $1 \times 10^{-4}$ | 5 | 500 | exposed for 30 minutes with THF vapor |
| 14 | CuPc | 50 × 50 × 3 | 500~600 | $1 \times 10^{-5}$~ $5 \times 10^{-5}$ | 5 | 2000 | — |
| 15 | CuPc | 50 × 50 × 3 | 500~600 | $1 \times 10^{-5}$~ $5 \times 10^{-5}$ | 5 | 2000 | — |
| 16 | AlClPc(Cl) | 50 × 50 × 3 | 450~490 | $5 \times 10^{-6}$~ $1 \times 10^{-4}$ | 5 | 500 | exposed for 30 minutes with THF vapor |
| 17 | AlClPc(Cl) | 50 × 50 × 3 | 450~490 | $5 \times 10^{-6}$~ $1 \times 10^{-4}$ | 5 | 500 | same as above |
| 18 | AlClPc(Cl) | 50 × 50 × 3 | 450~490 | $5 \times 10^{-6}$~ $1 \times 10^{-4}$ | 5 | 500 | same as above |
| 19 | AlClPc(Cl) | 50 × 50 × 3 | 450~490 | $5 \times 10^{-6}$~ $1 \times 10^{-4}$ | 5 | 500 | same as above |
| 20 | AlClPc(Cl) | 50 × 50 × 3 | 450~490 | $5 \times 10^{-6}$~ $1 \times 10^{-4}$ | 5 | 500 | same as above |
| 21 | AlClPc(Cl) | 50 × 50 × 3 | 450~490 | $5 \times 10^{-6}$~ $1 \times 10^{-4}$ | 5 | 500 | same as above |
| 22 | AlClPc(Cl) | 50 × 50 × 3 | 450~490 | $5 \times 10^{-6}$~ $1 \times 10^{-4}$ | 5 | 500 | same as above |

TABLE 2

| Ex. No. | (8) (sccm) | (9) (sccm) | (10) (sccm) | (11) (watt) | (12) (Torr) | (13) (°C.) | (14) | (15) (Hz) | (16) (hour) | (17) (μm) | (18) (at. %) | (19) (at. %) |
|---|---|---|---|---|---|---|---|---|---|---|---|---|
| | | | | Charge Transporting Layer Forming Step | | | | | | | | |
| 2 | 40 | $C_4H_6$ 30 | — | 150 | 1.0 | 75 | low | 100K | 2.5 | 7.6 | 43 | — |
| 3 | 40 | $C_4H_6$ 30 | — | 150 | 1.0 | 75 | low | 100K | 2.5 | 7.7 | 48 | — |
| 4 | 40 | $C_4H_6$ 30 | — | 150 | 1.0 | 75 | low | 100K | 2.5 | 7.6 | 45 | — |
| 5 | 40 | $C_4H_6$ 30 | — | 150 | 1.0 | 75 | low | 100K | 2.5 | 7.6 | 47 | — |
| 6 | 40 | $C_4H_6$ 30 | — | 150 | 1.0 | 75 | low | 100K | 2.5 | 7.8 | 46 | — |
| 7 | 40 | $C_4H_6$ 30 | — | 150 | 1.0 | 75 | low | 100K | 2.5 | 7.7 | 49 | — |
| 8 | 40 | $C_4H_6$ 30 | — | 150 | 1.0 | 75 | low | 100K | 2.5 | 7.9 | 43 | — |
| 9 | 40 | $C_4H_6$ 30 | — | 150 | 1.0 | 75 | low | 100K | 2.5 | 7.8 | 46 | — |
| 10 | 40 | $C_4H_6$ 30 | — | 150 | 1.0 | 75 | low | 100K | 2.5 | 7.6 | 47 | — |
| 11 | 40 | $C_4H_6$ 30 | — | 150 | 1.0 | 75 | low | 100K | 2.5 | 7.8 | 47 | — |
| 12 | 40 | $C_4H_6$ 30 | — | 150 | 1.0 | 75 | low | 100K | 2.5 | 7.7 | 46 | — |
| 13 | 40 | $C_4H_6$ 30 | — | 150 | 1.0 | 75 | low | 100K | 2.5 | 7.8 | 47 | — |
| 14 | 40 | $C_4H_6$ 30 | $CF_4$ 10 | 150 | 1.0 | 75 | low | 100K | 2.5 | 7.3 | 47 | 1.2 |
| 15 | 40 | $C_4H_6$ 30 | $CF_4$ 20 | 150 | 1.0 | 75 | low | 100K | 2.5 | 7.6 | 43 | 2.5 |
| 16 | 40 | $C_4H_6$ 30 | $CF_4$ 10 | 150 | 1.0 | 75 | low | 100K | 2.5 | 7.5 | 43 | 1.3 |
| 17 | 40 | $C_4H_6$ 30 | $CF_4$ 20 | 150 | 1.0 | 75 | low | 100K | 2.5 | 7.6 | 38 | 2.3 |
| 18 | 30 | $C_8H_8$ 20 | — | 150 | 0.25 | 60 | low | 30K | 0.5 | 13.8 | 47 | — |
| 19 | 60 | $C_2H_4$ 100 | — | 200 | 1.0 | 60 | low | 200K | 1.5 | 11.7 | 41 | — |
| 20 | 20 | $C_2H_2$ 30 | $CF_4$ 5 | 150 | 1.0 | 65 | high | 13.56 M | 1.5 | 9.6 | 35 | 0.5 |

TABLE 2-continued

| Ex. No. | (8) (sccm) | (9) (sccm) | (10) (sccm) | (11) (watt) | (12) (Torr) | (13) (°C.) | (14) | (15) (Hz) | (16) (hour) | (17) (μm) | (18) (at. %) | (19) (at. %) |
|---|---|---|---|---|---|---|---|---|---|---|---|---|
| | | Charge Transporting Layer Forming Step | | | | | | | | | | |
| 21 | 30 | $C_3H_6$ 60 | — | 150 | 0.75 | 60 | low | 200K | 2.5 | 8.8 | 40 | — |
| 22 | 10 | $C_{10}H_{16}$ 15 | — | 150 | 0.45 | 50 | low | 100K | 1 | 10.7 | 46 | — |

TABLE 3

| Ex. No. | (20) (V) | (21) (μm) | (22) (V/μm) | (23) (%) | (24) (lux-sec.) | (25) (V) | (26) (erg/cm²) | (27) | (28) |
|---|---|---|---|---|---|---|---|---|---|
| | | | | Result of Evaluation | | | | | |
| 2 | −410 | 7.8 | −53 | 26 | 3.6 | −25 | — | O | more than 7H |
| 3 | −450 | 7.9 | −57 | 11 | 20 | −45 | — | O | 7H |
| 4 | −430 | 7.75 | −55 | 2 | slightly | −340 | — | — | more than 7H |
| 5 | −320 | 8.05 | −40 | 15 | 15 | −30 | — | O | same as above |
| 6 | −330 | 7.95 | −42 | 24 | 2.9 | −15 | 22.3 | O | same as above |
| 7 | −220 | 7.85 | −28 | 26 | 3.4 | −15 | 19.4 | O | same as above |
| 8 | −410 | 8.05 | −51 | 7 | 22 | −60 | — | O | 7H |
| 9 | −470 | 7.95 | −59 | 5 | 55 | −180 | — | O | more than 7H |
| 10 | −420 | 7.75 | −54 | 7 | 30 | −90 | — | O | same as above |
| 11 | −430 | 7.85 | −55 | 28 | 2.0 | −20 | 9.5 | O | same as above |
| 12 | −370 | 7.75 | −54 | 2 | slightly | −370 | — | — | same as above |
| 13 | −410 | 7.85 | −52 | 22 | 2.0 | −15 | 6.8 | O | same as above |
| 14 | −420 | 7.5 | −56 | 16 | 12.3 | −25 | — | O | same as above |
| 15 | −420 | 7.8 | −54 | 20 | 9.6 | −15 | — | O | same as above |
| 16 | −410 | 7.55 | −54 | 21 | 1.8 | −15 | 6.2 | O | same as above |
| 17 | −420 | 7.65 | −55 | 25 | 1.6 | −10 | 5.9 | O | same as above |
| 18 | −420 | 13.82 | −33 | 21 | 2.5 | −20 | 7.6 | O | same as above |
| 19 | −420 | 11.75 | −36 | 22 | 3.8 | −35 | 7.5 | O | same as above |
| 20 | −420 | 9.65 | −28 | 28 | 1.3 | −10 | 6.0 | O | same as above |
| 21 | −420 | 8.85 | −47 | 22 | 5.6 | −35 | 7.6 | O | same as above |
| 22 | −420 | 10.75 | −39 | 25 | 2.1 | −15 | 6.2 | O | same as above |
| | +420 | 10.75 | +39 | 20 | 5.3 | +45 | 10.4 | O | same as above |

EXAMPLES 23 to 30

Photosensitive members were prepared, the members comprising an electrically conductive substrate (1), a charge transporting layer (2), a charge generating layer (3) and an overcoat layer (4) provided in this order as shown in FIG. 4. Charge transporting layers and overcoat layers were prepared by using the apparatus shown in FIG. 7.

The respective condition values for forming a charge generating layer, a charge transporting layer and an overcoat layer are shown in Table 4, Table 5 and Table 6. Table 7 indicates the results of the evaluation of each member.

The items shown in Tables 4, 5 and 7 are respectively the same as those in Tables 1, 2 and 3. The items shown in Table 6 for forming an overcoat layer are the same as those in Table 2.

As is apparent from Table 7, the photosensitive member according to the invention has high chargeability and high sensitivity.

TABLE 4

| Ex. No. | (1) | (2) (mm) | (3) (°C.) | (4) (Torr) | (5) (minute) | (6) (Å) | (7) |
|---|---|---|---|---|---|---|---|
| | | Charge Generating Layer Forming Step | | | | | |
| 23 | CuPc | 50 × 50 × 3 | 500~600 | $1 \times 10^{-5}$~ $5 \times 10^{-5}$ | 5 | 2000 | — |
| 24 | $H_2Pc$ | 50 × 50 × 3 | 480~500 | $1 \times 10^{-5}$~ $1.8 \times 10^{-5}$ | 5 | 2000 | — |
| 25 | AlClPc | 50 × 50 × 3 | 450~480 | $1 \times 10^{-5}$~ $3 \times 10^{-4}$ | 5 | 2000 | — |
| 26 | ZnPc | 50 × 50 × 3 | 570~600 | $2 \times 10^{-5}$~ $3 \times 10^{-5}$ | 6 | 1500 | — |
| 27 | MgPc | 50 × 50 × 3 | 565~590 | $1.5 \times 10^{-5}$~ $1.8 \times 10^{-5}$ | 7 | 1500 | — |
| 28 | AlClPc (Cl) | 50 × 50 × 3 | 450~490 | $5 \times 10^{-6}$~ $1 \times 10^{-4}$ | 5 | 500 | — |
| 29 | AlClPc (Cl) | 50 × 50 × 3 | 450~490 | $5 \times 10^{-6}$~ $1 \times 10^{-4}$ | 5 | 500 | exposed for 30 minutes with THF vapor |
| 30 | AlClPc (Cl) | 50 × 50 × 3 | 450~490 | $5 \times 10^{-6}$~ $1 \times 10^{-4}$ | 5 | 500 | same as above |

TABLE 5

| Ex. No. | (8) (sccm) | (9) (sccm) | (10) (sccm) | (11) (watt) | (12) (Torr) | (13) (°C.) | (14) | (15) (Hz) | (16) (hour) | (17) (μm) | (18) (at. %) | (19) (at. %) |
|---|---|---|---|---|---|---|---|---|---|---|---|---|
| | | Charge Transporting Layer Forming Step | | | | | | | | | | |
| 23 | 40 | $C_4H_6$ 30 | — | 150 | 1.0 | 75 | low | 100K | 2.5 | 7.8 | 47 | — |
| 24 | 40 | $C_4H_6$ 30 | — | 150 | 1.0 | 75 | low | 100K | 2.5 | 7.7 | 48 | — |
| 25 | 40 | $C_4H_6$ 30 | — | 150 | 1.0 | 75 | low | 100K | 2.5 | 7.7 | 48 | — |
| 26 | 40 | $C_4H_6$ 30 | — | 150 | 1.0 | 75 | low | 100K | 2.5 | 7.8 | 46 | — |
| 27 | 40 | $C_4H_6$ 30 | — | 150 | 1.0 | 75 | low | 100K | 2.5 | 7.7 | 49 | — |
| 28 | 40 | $C_4H_6$ 30 | — | 150 | 1.0 | 75 | low | 100K | 2.5 | 7.8 | 47 | — |
| 29 | 40 | $C_4H_6$ 30 | — | 150 | 1.0 | 75 | low | 100K | 2.5 | 7.8 | 47 | — |
| 30 | 40 | $C_4H_6$ 30 | $CF_4$ 10 | 150 | 1.0 | 75 | low | 100K | 2.5 | 7.5 | 43 | 1.3 |

TABLE 6

| Ex. No. | (8) (sccm) | (9) (sccm) | (10) (sccm) | (11) (watt) | (12) (Torr) | (13) (°C.) | (14) | (15) (Hz) | (16) (hour) | (17) (Å) | (18) (at. %) | (19) (at. %) |
|---|---|---|---|---|---|---|---|---|---|---|---|---|
| | | Overcoat Layer Forming Step | | | | | | | | | | |
| 23 | 40 | $C_4H_6$ 30 | — | 150 | 1.0 | 75 | low | 100K | 0.25 | 3000 | 47 | — |
| 24 | 40 | $C_4H_6$ 30 | — | 150 | 1.0 | 75 | low | 100K | 0.25 | 2500 | 43 | — |
| 25 | 40 | $C_4H_6$ 30 | — | 150 | 1.0 | 75 | low | 100K | 0.25 | 3000 | 48 | — |
| 26 | 40 | $C_4H_6$ 30 | — | 150 | 1.0 | 75 | low | 100K | 0.25 | 3000 | 46 | — |
| 27 | 40 | $C_4H_6$ 30 | — | 150 | 1.0 | 75 | low | 100K | 0.25 | 3000 | 49 | — |
| 28 | 40 | $C_4H_6$ 30 | — | 150 | 1.0 | 75 | low | 100K | 0.25 | 3000 | 47 | — |
| 29 | 40 | $C_4H_6$ 30 | — | 150 | 1.0 | 75 | low | 100K | 0.25 | 3000 | 47 | — |
| 30 | 40 | $C_4H_6$ 30 | $CF_4$ 10 | 150 | 1.0 | 75 | low | 100K | 0.25 | 3000 | 43 | 1.3 |

TABLE 7

| Ex. No. | (20) (V) | (21) (μm) | (22) (V/μm) | (23) (%) | (24) (lux-sec.) | (25) (V) | (26) (erg/cm²) | (27) | (28) |
|---|---|---|---|---|---|---|---|---|---|
| | | | | Result of Evaluation | | | | | |
| 23 | +420 | 8.3 | +51 | 16 | 17.4 | +30 | — | O | more than 7H |
| 24 | +410 | 8.05 | +51 | 24 | 3.2 | +15 | — | O | same as above |
| 25 | +420 | 8.2 | +51 | 13 | 14.2 | +35 | — | O | same as above |
| 26 | +390 | 8.25 | +47 | 15 | 2.5 | +30 | 14.2 | O | same as above |
| 27 | +340 | 8.15 | +42 | 20 | 2.8 | +20 | 16.0 | O | same as above |
| 28 | +420 | 8.15 | +52 | 29 | 1.8 | +25 | 7.5 | O | same as above |
| 29 | +420 | 8.15 | +52 | 25 | 1.8 | +10 | 5.8 | O | same as above |
| 30 | +400 | 7.85 | +51 | 25 | 1.4 | +10 | 5.4 | O | same as above |

EXAMPLES 31 to 36

Photosensitive members were prepared, the members comprising an electrically conductive substrate (1), a charge generating layer (3) and a charge transporting layer (2) provided in this order as shown in FIG. 2. The charge transporting layers of Examples 31 to 34 were prepared by using the apparatus shown in FIG. 7, while the apparatus shown in FIG. 8 was used for forming the charge transporting layers of Example 35 and 36.

The respective condition values for forming a charge generating layer and a charge transporting layer are shown in Table 8 and Table 9. Table 10 indicates the results of the evaluation of each member.

The items shown in Tables 8, 9 and 10 are respectively the same as those in Tables 1, 2 and 3.

As is apparent from Table 10, the photosensitive member according to the invention has high chargeability and high sensitivity.

TABLE 8

| Ex. No. | (1) | (2) (mm) | (3) (°C.) | (4) (Torr) | (5) (minute) | (6) (Å) | (7) |
|---|---|---|---|---|---|---|---|
| | | Charge Generating Layer Forming Step | | | | | |
| 31 | AlClPc (Cl) | 50 × 50 × 3 | 450~490 | $5 \times 10^{-6}$~ $1 \times 10^{-4}$ | 5 | 200 | exposed for 30 minutes with THF |

TABLE 8-continued

| Ex. No. | (1) | (2) (mm) | (3) (°C.) | (4) (Torr) | (5) (minute) | (6) (Å) | (7) |
|---|---|---|---|---|---|---|---|
| | | Charge Generating Layer Forming Step | | | | | |
| 32 | AlClPc (Cl) | 50 × 50 × 3 | 450~490 | $5 \times 10^{-6}$~ $1 \times 10^{-4}$ | 5 | 5000 | vapor same as above |
| 33 | AlClPc (Cl) | 50 × 50 × 3 | 450~490 | $5 \times 10^{-6}$~ $1 \times 10^{-4}$ | 5 | 10000 | same as above |
| 34 | AlClPc (Cl) | 50 × 50 × 3 | 450~490 | $5 \times 10^{-6}$~ $1 \times 10^{-4}$ | 5 | 20000 | same as above |
| 35 | AlClPc (Cl) | ϕ80 × 329 * | 450~490 | $5 \times 10^{-6}$~ $1 \times 10^{-4}$ | 5 | 500 | same as above |
| 36 | AlClPc (Cl) | ϕ80 × 329 * | 450~490 | $5 \times 10^{-6}$~ $1 \times 10^{-4}$ | 5 | 500 | same as above |

*This value shows a diameter × length of a cylindrical aluminum substrate.

TABLE 9

| Ex. No. | (8) (sccm) | (9) (sccm) | (10) (sccm) | (11) (watt) | (12) (Torr) | (13) (°C.) | (14) | (15) (Hz) | (16) (hour) | (17) (μm) | (18) (at. %) | (19) (at. %) |
|---|---|---|---|---|---|---|---|---|---|---|---|---|
| | | Charge Transporting Layer Forming Step | | | | | | | | | | |
| 31 | 40 | $C_4H_6$ 30 | — | 150 | 1.0 | 75 | low | 100K | 2.5 | 7.8 | 47 | — |
| 32 | 40 | $C_4H_6$ 30 | — | 150 | 1.0 | 75 | low | 100K | 2.5 | 7.8 | 47 | — |
| 33 | 40 | $C_4H_6$ 30 | — | 150 | 1.0 | 75 | low | 100K | 2.5 | 7.8 | 47 | — |
| 34 | 40 | $C_4H_6$ 30 | — | 150 | 1.0 | 75 | low | 100K | 2.5 | 7.8 | 47 | — |
| 35 | 230 | $C_2H_4$ 180 | — | 250 | 0.7 | 60 | high | 13.56 M | 3.5 | 8.2 | 32 | — |
| 36 | 230 | $C_2H_2$ 180 | $CF_4$ 125 | 200 | 1.0 | 60 | high | 13.56 M | 2.3 | 8.0 | 35 | — |

TABLE 10

| Ex. No. | (20) (V) | (21) (μm) | (22) (V/μm) | (23) (%) | (24) (lux-sec.) | (25) (V) | (26) (erg/cm²) | (27) | (28) |
|---|---|---|---|---|---|---|---|---|---|
| | | | | Result of Evaluation | | | | | |
| 31 | −450 | 7.72 | −58 | 18 | 3.8 | −20 | 12.4 | ○ | more than 7H |
| 32 | −420 | 8.2 | −51 | 20 | 1.8 | −18 | 6.2 | ○ | same as above |
| 33 | −220 | 8.7 | −25 | 42 | 1.5 | −10 | 5.6 | ○ | same as above |
| 34 | −150 | 8.0 | −15 | 55 | 0.9 | 0 | 4.6 | ○ | same as above |
| 35 | −430 | 8.25 | −52 | 18 | 2.4 | −25 | 7.3 | ○ | same as above |
| 36 | −430 | 8.05 | −53 | 24 | 1.2 | −5 | 5.6 | ○ | same as above |

What is claimed is:

1. A photosensitive member comprising:

an electrically conductive substrate;

a vacuum evaporated layer formed from phthalocyanine compounds serving as a charge generating layer; and a plasma polymerized layer serving as a charge transporting layer comprising amorphous carbon containing hydrogen.

2. A photosensitive member as claimed in claim 1 wherein the hydrogen atoms are contained in the plasma polymerized layer in an amount of about 30 to about 60 atomic % based on the combined amount of hydrogen atoms and carbon atoms.

3. A photosensitive member as claimed in claim 1 wherein the thickness of the vacuum evaporated layer is about 200 angstroms to about 2 microns.

4. A photosensitive member as claimed in claim 1 wherein the thickness of the plasma polymerized layer is about 5 to 50 microns.

* * * * *